United States Patent [19]

Dumas et al.

[11] Patent Number: 5,042,115

[45] Date of Patent: Aug. 27, 1991

[54] FASTENER FOR A FLEXIBLE BAND, SUCH AS A WATCHBAND, BRACELET OR BELT

[75] Inventors: Jean-Louis Dumas; André Leboube, both of Paris, France

[73] Assignee: Hermes, Paris, France

[21] Appl. No.: 612,021

[22] Filed: Nov. 9, 1990

[30] Foreign Application Priority Data

Nov. 10, 1989 [FR] France ..... 89 14803

[51] Int. Cl.[5] ..... A44B 11/25

[52] U.S. Cl. ..... 24/180; 24/71 J; 24/265 WS

[58] Field of Search ..... 24/180, 178, 179, 189, 24/188, 192, 71 R, 71 J, 265 WG, 573.1, 182

[56] References Cited

U.S. PATENT DOCUMENTS

| | | | |
|---|---|---|---|
| 117,742 | 8/1871 | Clark | 24/180 |
| 142,907 | 9/1873 | Frazer | 24/180 |
| 482,289 | 9/1892 | Ziegler | 24/180 |
| 4,382,318 | 5/1983 | Takimoto | 24/188 |
| 4,675,955 | 6/1987 | Nakamura | 24/265 WS |

FOREIGN PATENT DOCUMENTS

| | | |
|---|---|---|
| 1956105 | 5/1971 | Fed. Rep. of Germany . |
| 2935245 | 7/1980 | Fed. Rep. of Germany . |
| 972540 | 1/1951 | France . |
| 416191 | 1/1967 | Switzerland . |
| 465942 | 1/1969 | Switzerland . |
| 1505003 | 3/1978 | United Kingdom . |

*Primary Examiner*—Victor N. Sakran

*Attorney, Agent, or Firm*—Sughrue, Mion, Zinn Macpeak & Seas

[57] ABSTRACT

This fastener comprises two elements (3, 4) connected to the band (1), the first element (3) including a pin (9) adapted to be fitted into retaining bearing surfaces (12) defined by hooks (13) on the second element (4), and a clasp (11) associated with the pin (9) and capable of being swung over and locked onto the second element (4). The second element (4) is provided with a safety hook (16) pivotally mounted on a transverse pin (10) of the second element and capable of being clipped onto the pin (9) of the first element (3) before the clasp (11) is swung over onto the second element (4). The fastener may be easily adjusted with one hand and does not require the provision of adjustment orifices on the band and hides the free end portion of the band, this end portion of the band being indeed interposed between the surface of the object surrounded by the band and the end portion (1*a*) of the band carrying the first element (3).

6 Claims, 1 Drawing Sheet

FASTENER FOR A FLEXIBLE BAND, SUCH AS A WATCHBAND, BRACELET OR BELT

The present invention relates to a fastener for a flexible band, for example a watchband, bracelet or belt.

Known fasteners of this type have various drawbacks, in particular the requirement of a series of orifices in the band for their adjustment, the presence of an end portion of the band which extends beyond the fastener and must be retained in a loop of the watchband or bracelet or the clothing to which the belt is connected, and a fastening safety which is often insufficient. Indeed, in the case of fasteners comprising a cover forming a clasp, the latter sometimes becomes accidentally unlocked.

An object of the invention is to provide a fastener for a flexible band in which these drawbacks are avoided.

The invention provides a fastener for a flexible band which comprises two elements connected to the band, the first element including a pin adapted to be capable of fitting in retaining bearing surfaces provided on the second element, and a clasp associated with the pin and capable of being swung over and locked to the second element.

According to the invention, the second element is provided with a safety hook pivotally mounted on a transverse pin on said element and capable of being clipped onto the pin of the first element before the clasp is swung over onto the second element.

The second element may be mounted in an adjustable position on the band, while the first element may be fixed to an end portion of the band. As the second element is suitably positioned on the band, it will be understood that the free end portion of the band located beyond the second element is interposed between the skin or the clothing of the user and the end portion of the band to which the first element is secured.

The unsightly and bothersome free end portion of the band is in this way hidden.

Further features and advantages will be apparent from the following description with reference to the accompanying drawing which illustrates an embodiment of the invention by way of a non-limitative example.

Figure 1:
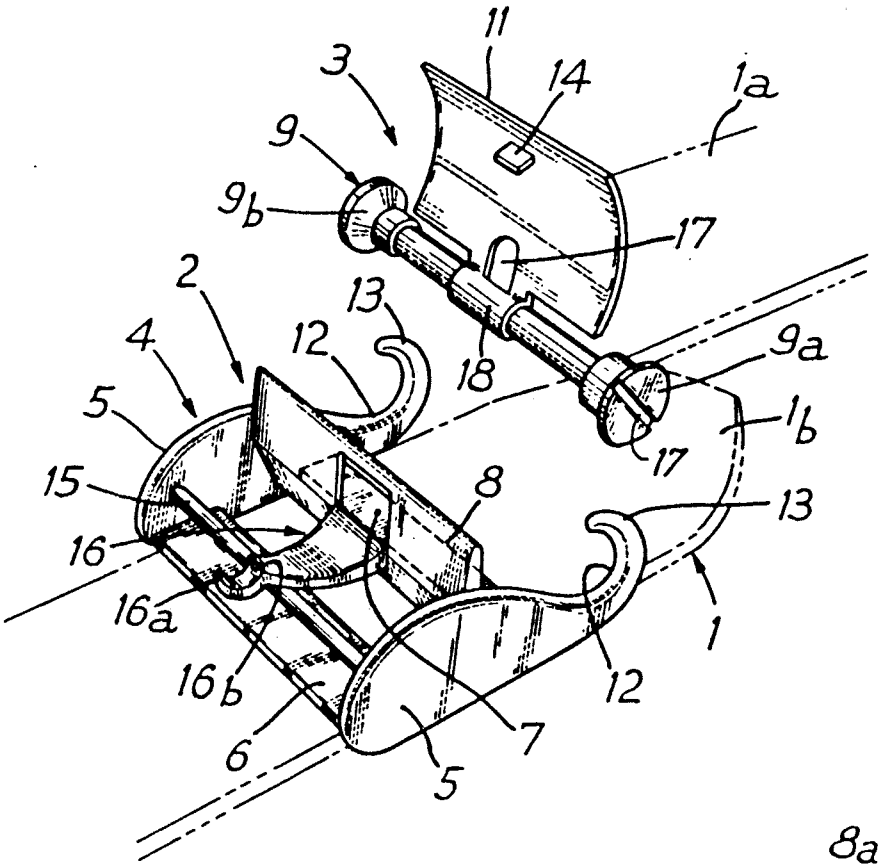
FIG. 1 is an exploded perspective view of an embodiment of the fastener for a flexible band according to the invention.

The fastener illustrated in the drawing is intended for a flexible band 1 such as a watchband, bracelet or a belt, the two end portions 1*a* and 1*b* of which are shown.

This fastener 2 comprises two elements 3 and 4 connected to the band 1, namely in the presently-described embodiment the end portion 1*a* and the end portion 1*b* respectively. The element 3 is fixed to the end of the end portion 1*a*, while the element 4 is slipped over the end portion 1*b* to an adjustable position depending on the size of the support which must be surrounded by the band 1, for example a wrist if it concerns a watchband or bracelet.

To this end, the element 4 comprises two side walls 5 interconnected by transverse bars 6, 7 and a plate 8 mounted to be pivotal about a transverse pin 10, the band 1*b* passing between on one hand the plate 8 and the pin 10 and on the other hand the bars 6 and 7. The plate 8 has an L-shaped section with a longitudinal edge portion 8*a* making with the remainder of the plate an angle slightly greater than 90°. This enables the band 1*b* to be inserted when this plate is closed between the transverse bars 6 and 7 so that it can be prevented from slipping.

The element 3 includes a pin 9 which carries a cover 11 constituting a clasp and which is adapted to be capable of being fitted in retaining bearing surfaces 12 provided on hooks 13 on the second element 4. In the presently-described embodiment, the hooks 13 are provided at the ends of the side walls 5 with which they form one piece.

Figure 2:
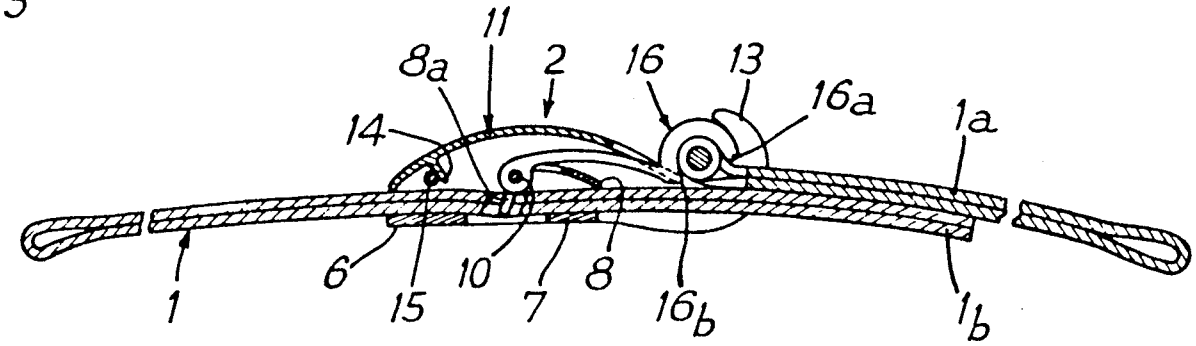
FIG. 2 is a longitudinal sectional view of a flexible band provided with the fastener shown in FIG. 1 in the locked position thereof.

The clasp 11, which is preferably convex on the outside of the fastener, is provided with a central boss 14 which is capable of being swung over and locked onto a transverse rod 15 interconnecting the side walls 5, by a clipping of the boss 14 onto this rod 15 (FIG. 2).

The pin 9 may be made in two separable parts, for example two semi-pins 9*a*, 9*b* which are screwed into a central sleeve 18 on the cover 11. In order to facilitate this screwing, lateral surfaces of heads of the semi-pins 9*a*, 9*b* are provided with slots 17 suitable for screwing by means of a screwdriver.

The element 4 is provided with a safety hook 16 pivotally mounted on the pin 10 and having an active curved end portion with a radius of curvature corresponding to the radius of curvature of the sleeve 18 so as to be placed on the latter. This curved end portion is defined on one side by a point 16*a* and on the other side by a boss 16*b* which is so positioned and dimensioned as to come to rub against the sleeve 18 and lock the hook 16 on the latter. In addition, an opening 17 is provided at the base of the clasp 11 and in its central part in facing relation to the sleeve 18.

The opening 17 enables the clasp 11 to be swung over onto the end portion of the safety hook 16 after the latter has been clipped onto the sleeve 18.

The fastener just described is very easily employed in the following manner.

After having suitably positioned the element 4 by sliding it along the flexible band 1 and locking the latter by swinging over the plate 8 onto the end portion 1*b*, the user places the pin 9 on the bearing surfaces 12 of the hooks 13, the clasp 11 having been raised to the position shown in FIG. 1. The user then swings the safety hook 16 over in such manner that its curved end portion is applied against the sleeve 18 with a locking in this position by means of the boss 16*b*. It is then merely necessary to swing the clasp 11 over to the position shown in FIG. 2 in which it is maintained by friction of the boss 14 against the transverse rod 15.

The fastener can therefore be placed in position with only one hand and the band remains closed even if the clasp-cover 11 has been accidentally raised. Indeed, the safety hook 16 remains in position and guarantees that the pin 9 is maintained in the element 4.

To open the fastener, it is sufficient to raise the clasp 11, then the hook 16, which are operations presenting no difficulty.

It will be observed that the end portion 1*b* of the band 1 on which the element 4 is mounted is interposed, after the locking of the fastener, between the object surrounded by the band and the end portion 1*a* of the band carrying the element 3. Consequently, the end portion 1*b* is not only invisible so that the band as viewed from the exterior is rendered more aesthetic, it no longer needs to be maintained in position by additional loops as in conventional devices.

As a variant, it is possible to reverse the elements 3 and 4, i.e. to position the element 3 with its clasp 11 on the end portion 1*b* instead of the element 4 and to secure the latter at the end of the end portion 1*a* of the band 1. It is also possible to make the clasp 11, the sleeve 18 and the pin 9 in one piece, which facilitates an improved closing of the clasp. Further, if desired, the clasp 11 could be pivotally mounted on the pin 9.

The two semi-pins 9*a*, 9*b* may be screwed into a central connecting tube extending through the sleeve 18, or one inside the other.

The clasp 11 may be fixed to or not fixed to the pin 9.

In the case where the clasp is fixed to the pin 9, the latter is made in two parts which are screwed and jammed in the sleeve 18.

In the case where the clasp is not fixed to the pin 9, the latter is in a single piece and the clasp 11 is then freely mounted on the pin 9, including in the lateral direction.

The boss 14 of the clasp 11 may be shifted so as to be placed in front of the pin 10 of the safety hook 16. The clasp 11 can then be swung over and locked onto the pin 10 and the rod 15 may be eliminated.

What is claimed is:

1. A fastener for a flexible band, such as a watchband, bracelet or belt, said fastener comprising a first element connected to said band, a second element connected to said band, a first pin carried by said first element, means defining retaining bearing surfaces provided on said second element, said first pin being capable of fitting in said retaining bearing surfaces, a clasp pivotally mounted on said first pin and capable of being swung over and locked onto said second element, said second element being provided with a transverse second pin and a safety hook pivotally mounted on said second pin and capable of being clipped onto said first pin before said clasp is swung over onto said second element.

2. A fastener according to claim 1, wherein said clasp comprises a cover defining at a base of said cover in the vicinity of said first pin an opening for the passage of an end portion of said safety hook which extends through said opening after said clasp has been swung over.

3. A fastener according to claim 1, wherein said clasp is fixed to said first pin and said first pin is made in two parts, a central sleeve being provided on said clasp and said two parts being screwed and jammed in said central sleeve.

4. A fastener according to claim 1, wherein said first pin is in a single piece and said clasp is mounted to be freely movable on said first pin, including in a lateral direction.

5. A fastener according to claim 1, further comprising a transverse third pin provided on said second element, a central boss on said clasp which is capable of being swung over and locked onto said transverse third pin of said second element.

6. A fastener according to claim 1, further comprising a central boss on said clasp which is capable of being swung over and locked onto said transverse second pin.

* * * * *